US011745966B2

(12) United States Patent
Shirasaki

(10) Patent No.: US 11,745,966 B2
(45) Date of Patent: Sep. 5, 2023

(54) SHEET FEEDING DEVICE AND IMAGE FORMING SYSTEM THEREWITH

(71) Applicant: KYOCERA Document Solutions Inc., Osaka (JP)

(72) Inventor: Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 231 days.

(21) Appl. No.: 17/343,990

(22) Filed: Jun. 10, 2021

(65) Prior Publication Data

US 2021/0387822 A1 Dec. 16, 2021

(30) Foreign Application Priority Data

Jun. 15, 2020 (JP) ..... 2020-102826

(51) Int. Cl.

| | |
|---|---|
| ***B65H 1/18*** | (2006.01) |
| ***B65H 7/02*** | (2006.01) |
| ***B65H 1/12*** | (2006.01) |
| ***B65H 3/06*** | (2006.01) |
| ***B65H 11/00*** | (2006.01) |

(52) U.S. Cl.

CPC ..... *B65H 1/18* (2013.01); *B65H 1/12* (2013.01); *B65H 3/06* (2013.01); *B65H 7/02* (2013.01); *B65H 11/00* (2013.01); *B65H 2601/122* (2013.01)

(58) Field of Classification Search

CPC ..... B65H 1/14; B65H 1/18; B65H 2601/122
See application file for complete search history.

(56) References Cited

U.S. PATENT DOCUMENTS

| | | | | |
|---|---|---|---|---|
| 5,897,112 | A * | 4/1999 | Kwag | B65H 1/266 271/38 |
| 7,523,930 | B2 * | 4/2009 | Kang | B65H 1/20 271/152 |
| 8,403,318 | B2 * | 3/2013 | Shiraishi | B65H 1/266 271/130 |
| 10,029,866 | B2 * | 7/2018 | Harada | B65H 1/266 |
| 10,308,451 | B2 * | 6/2019 | Kikuta | B65H 1/18 |
| 11,560,001 | B2 * | 1/2023 | Shirasaki | B65H 33/04 |

(Continued)

FOREIGN PATENT DOCUMENTS

| | | | |
|---|---|---|---|
| JP | 06179544 | A * | 6/1994 |
| JP | 2013-180842 | A | 9/2013 |
| JP | 2013-193826 | A | 9/2013 |

*Primary Examiner* — Howard J Sanders
(74) *Attorney, Agent, or Firm* — Stein IP, LLC

(57) ABSTRACT

A sheet feeding apparatus includes a sheet stacking portion, a lift plate, an actuating segment, driving unit, a sheet feeding portion, a first detecting portion, a remaining amount detection portion. The remaining amount detection portion includes a detection piece, a link mechanism, a second detecting portion, a controller. The link mechanism couples together the driving shaft and the detection piece at a coupling position attained by pivoting the lift plate through a predetermined angle from a lower limit position in rotation direction, so as to let the driving shaft and the detection piece rotate together. The second detecting portion senses whether or not the detection piece is present. The controller determines the remaining quantity level of the stacked sheets according to whether or not the second detecting portion is detecting the detection piece being present.

5 Claims, 8 Drawing Sheets

(56) References Cited

U.S. PATENT DOCUMENTS

| | | | | |
|---|---|---|---|---|
| 11,611,673 | B2 * | 3/2023 | Shirasaki | H04N 1/00644 |
| 2013/0222505 | A1 | 8/2013 | Akatsuka et al. | 347/110 |
| 2013/0243448 | A1 | 9/2013 | Naoi | 399/23 |

* cited by examiner

SHEET FEEDING DEVICE AND IMAGE FORMING SYSTEM THEREWITH

INCORPORATION BY REFERENCE

This application is based on and claims the benefit of Japanese Patent Application No. 2020-102826 filed on Jun. 15, 2020, the contents of which are hereby incorporated by reference.

BACKGROUND

The present disclosure relates to a sheet feeding device for inserting a cover sheet, a slip sheet, or the like among a plurality of sheets having images formed on them by an image forming apparatus such as a copier, facsimile machine, or printer. The present disclosure also relates to an image forming system that employs such a sheet feeding device.

A known image forming system includes an image forming apparatus, a sheet feeding apparatus connected downstream of the image forming apparatus, and a sheet post-processing apparats connected downstream of the sheet feeding apparatus. In this image forming system, among a plurality of output sheets having images formed on them by the image forming apparatus, insertion sheets to become cover sheets or slip sheets are inserted to produce a bundle of sheets that includes output sheets and insertion sheets, and the bundle of sheets is subjected to predetermined post-processing by the sheet post-processing apparatus to produce a booklet.

SUMMARY

According to one aspect of the present disclosure, a sheet feeding apparatus includes a sheet stacking portion, a lift plate, an actuating segment, a driving unit, a sheet feeding portion, a first detecting portion, and a remaining amount detection portion. On the sheet stacking portion, sheets are stacked the lift plate is disposed on the bottom surface of the sheet stacking portion, and is ascendable-descendable about an upstream end part of the lift plate in the sheet feed direction. The actuating segment is disposed between the bottom surface and the lift plate, and pivots about a driving shaft extending in the direction orthogonal to the sheet feed direction so as to raise and lower a downstream end part of the lift plate with respect to the sheet feed direction. The driving unit is coupled to the driving shaft, and raises and lowers the actuating segment via the driving shaft. The sheet feeding portion is disposed over the lift plate so as to face it, and feeds sheets raised to a feeding portion by the lift plate. The first detecting portion senses the top surface of the sheets located at the feeding portion. The remaining amount detection portion senses as a remaining quantity level whether or not the remaining quantity of sheets stacked on the feeding portion is more or less than a predetermined quantity. The remaining amount detection portion includes a detection piece, a link mechanism, a second detecting portion, and a controller. The detection piece has a base end part of it pivoted on the driving shaft, and is provided so as to be pivotable about the driving shaft. The link mechanism couples together the driving shaft and the detection piece at a coupling position attained by pivoting the lift plate through a predetermined angle from the lower limit position in the rotation direction, so as to let the driving shaft and the detection piece rotate together. The second detecting portion senses whether or not, with the lift plate located at the feeding portion, the detection piece is present. The controller determines the remaining quantity level of the stacked sheets according to whether or not, with the first detecting portion detecting the top surface of the sheets, the second detecting portion is detecting the detection piece being present.

This and other objects of the present disclosure, and the specific benefits obtained according to the present disclosure, will become apparent from the description of embodiments which follows.

DETAILED DESCRIPTION

Figure 1:
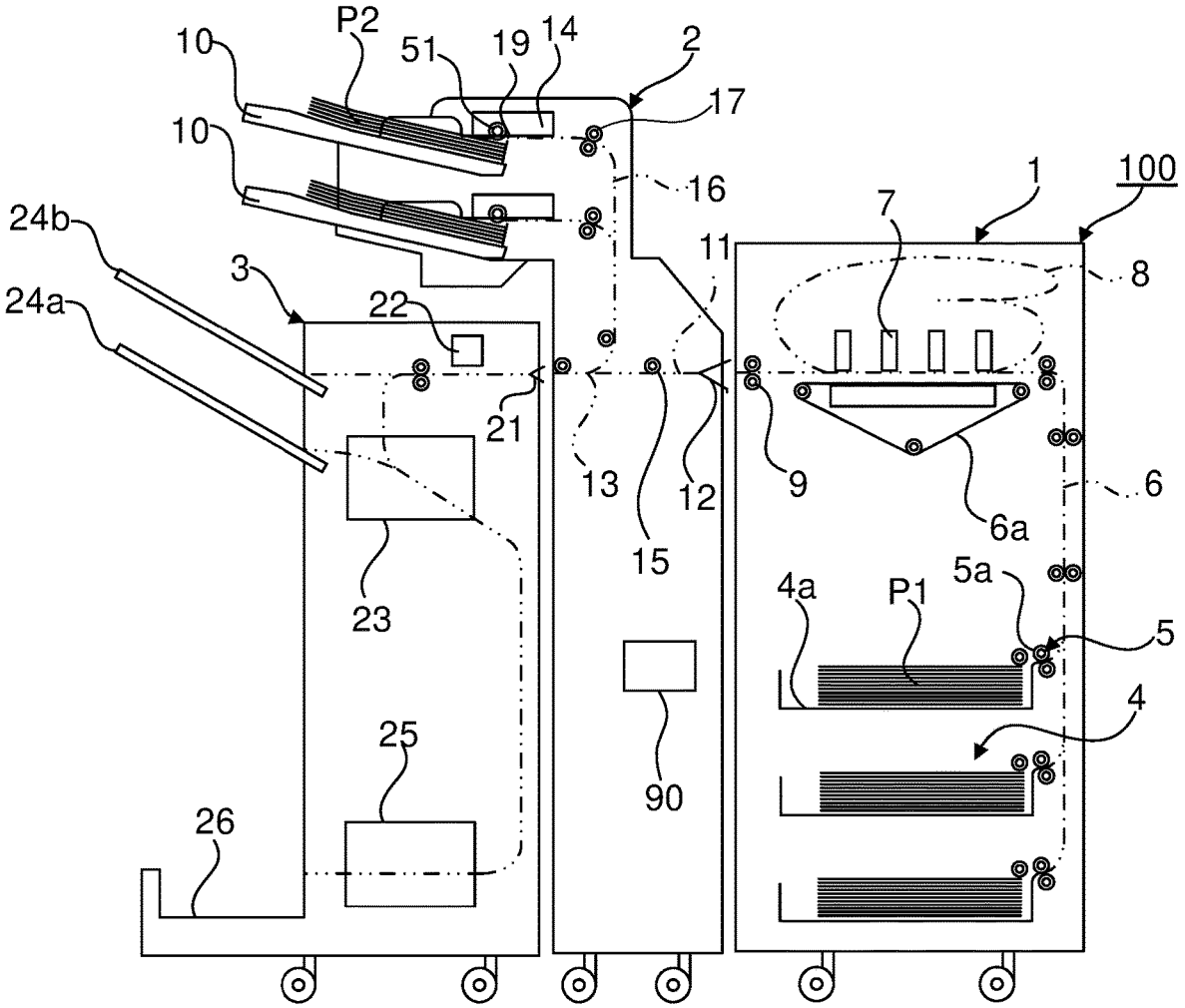
FIG. 1 is a schematic diagram showing an internal construction of an image forming apparatus, a sheet feeding apparatus, and a sheet post-processing apparatus that constitute an insertion sheet.

Hereinafter, with reference to the accompanying drawings, an embodiment of a sheet feeding apparatus according to the present disclosure and an image forming system employing it will be described.

First with reference to FIG. 1 a description will be given of an image forming system 100 comprising an image forming apparatus 1, a sheet feeding apparatus 2 according to the present disclosure, and a sheet post-processing apparatus 3. This embodiment deals with a image forming system 100 that employs as the image forming apparatus a printer of an inkjet recording type, though any other image forming apparatus (e.g., a laser printer or copier, or a facsimile machine) may be employed instead. The direction in which output sheets P1 output from the image forming apparatus 1 and insertion sheets P2 inserted from the sheet feeding apparatus 2 are conveyed toward the sheet post-processing apparatus 3 will be referred to as the sheet conveyance direction. With respect to the sheet conveyance direction, downstream refers to the side where the sheet post-processing apparatus 3 is located, whereas upstream refers to the side where a sheet storage portion 4 in the image forming apparatus 1, where output sheets P1 are stored, and a sheet stacking portion 10 in the sheet feeding apparatus 2, where insertion sheets P2 are stacked, are located.

FIG. 1 is a schematic diagram showing an internal construction of the image forming apparatus 1, the sheet feeding apparatus 2, and the sheet post-processing apparatus 3 that constitute the image forming system 100. Downstream of the image forming apparatus 1, the sheet feeding apparatus 2 is connected to it; downstream of the sheet feeding apparatus 2, the sheet post-processing apparatus 3 is connected to it.

The image forming apparatus 1 includes the sheet storage portion 4, which is provided in a lower part of the image forming apparatus 1; a sheet conveyance passage 6, which is disposed at a side of the sheet storage portion 4 and which extends downstream in the sheet conveyance direction; a sheet feeding portion 5, which is provided between the sheet conveyance passage 6 and the sheet storage portion 4; an image recording portion 7, which is disposed so as to face the sheet conveyance passage 6 in the height direction; and a reversing conveyance portion 8, which branches off the sheet conveyance passage 6 to extend over the image recording portion 7.

In the sheet storage portion 4, a plurality of (here three) sheet feeding cassettes 4*a* are removably provided, on which bundles of output sheets P1 are placed. The sheet feeding portion 5 feeds the output sheets P1 stored in the sheet storage portion 4 to the sheet conveyance passage 6 by the action of a pair of feed rollers 5*a* provided downstream of each of the sheet feeding cassette 4*a*.

Under the image recording portion 7, a conveying belt 6*a* is provided, which is endless and which is stretched around a plurality of rollers including a driving roller. The conveying belt 6*a* has formed in it a large number of ventilation holes (not illustrated) for air suction. An output sheet P1 fed out from the sheet feeding portion 5 passes, in a state held on the conveying belt 6*a* under suction by a sheet suction portion provided inside the loop of the conveying belt 6*a*, under the image recording portion 7.

The image recording portion 7 includes a plurality of inkjet heads, which eject ink toward the output sheet P1 conveyed in the state held on the conveying belt 6*a* under suction. The inkjet heads are supplied respectively with ink of four colors (cyan, magenta, yellow, and black) stored in ink tanks.

When recording is performed on both sides of an output sheet P1, the reversing conveyance portion 8 switches the conveyance direction of (switches back) the output sheet P1 having recording on one side finished, and turns over the output sheet P1 reverse side up; the reversing conveyance portion 8 then conveys the output sheet P1, with the side having no image recorded on it yet facing up, once again to the image recording portion 7. Output sheets P1 having predetermined images recorded on them by the image recording portion 7 are discharged one by one via a pair of discharge rollers 9.

The output sheets P1 discharged from the image forming apparatus 1 are introduced one by one into the sheet feeding apparatus 2. Among the plurality of output sheets P1 so introduced, the sheet feeding apparatus 2 inserts, with predetermined timing, insertion sheets P2, such as front covers and back covers (cover sheets) used in binding and slip sheets (insertion sheets) for indexing. That is, the sheet feeding apparatus 2 is an inserter that inserts insertion sheets P2 into a bundle of sheets comprising output sheets P1. The sheet feeding apparatus 2 then conveys those output sheet P1 and insertion sheet P2 to the sheet post-processing apparatus 3.

The sheet feeding apparatus 2 includes the sheet stacking portion 10. On the sheet stacking portion 10, insertion sheets P2 are stacked. Below the sheet stacking portion 10, there are provided a sheet inlet port 12, through which output sheets P1 discharged from the image forming apparatus 1 are introduced, and a relay conveyance passage 11, along which they are conveyed from the sheet inlet port 12 to the sheet post-processing apparatus 3. On the relay conveyance passage 11, a relay conveying roller 15 is disposed. The relay conveying roller 15 conveys downstream the output sheet P1 it has received.

Over the relay conveyance passage 11, an insertion conveyance passage 16 is provided. An upstream end opening 19 of the insertion conveyance passage 16 is adjacent to the sheet stacking portion 10 in the sheet conveyance direction. A downstream end part of the insertion conveyance passage 16 forms a confluence portion 13 that meets the relay conveyance passage 11. The insertion conveyance passage 16 forms a passage through which the sheet stacking portion 10 and the relay conveyance passage 11 communicate with each other. Over the upstream end opening 19 of the relay conveyance passage 11, a sheet feeding portion 14 is provided. The sheet feeding portion 14 includes a sheet feed roller 51, which is provided adjacent to the upstream end opening 19 of the insertion conveyance passage 16 in the sheet conveyance direction. The sheet feeding portion 14 feeds, by the action of the sheet feed roller 51, insertion sheets P2 from the sheet stacking portion 10 to the insertion conveyance passage 16. Midway along the insertion conveyance passage 16 in the sheet conveyance direction, a pair of conveying rollers 17 is provided. An insertion sheet P2 fed into the insertion conveyance passage 16 is conveyed by the pair of conveying rollers 17 to the confluence portion 13. The insertion sheet P2 conveyed to the confluence portion 13 is inserted into the relay conveyance passage 11 to be conveyed to the sheet post-processing apparatus 3.

The sheet post-processing apparatus 3 performs predetermined post-processing, such as punch hole formation or binding, on a bundle of sheets that includes a plurality of output sheets P1 output from the image forming apparatus 1 as well as insertion sheets P2 inserted among those output sheets P1.

The sheet post-processing apparatus 3 includes a sheet inlet port 21 through which it receives the output sheets P1 and insertion sheets P2 that are conveyed from the sheet feeding apparatus 2. The sheet post-processing apparatus 3 includes, inside it, a punch hole forming device 22, which forms punch holes in the output sheets P1 and insertion sheets P2 introduced through the sheet inlet port 21; an end binding unit 23, which stacks the introduced output sheets P1 and insertion sheets P2 to form a bundle of sheets, aligns an end part of it, and binds it with staples; and a middle-binding middle-folding unit 25, which staples a bundle of sheets at the middle and then folds it about the stapled part into the form of a booklet. On a side surface of the sheet post-processing apparatus 3, there is provided a main tray 24*a*, which is ascendable-descendable to a position suitable for discharge of a bundle of sheets, and a subsidiary tray 24*b*, which is fixed to an upper part of the sheet post-processing apparatus 3.

The punch hole forming device 22 is disposed in an upper part of the sheet post-processing apparatus 3. The output sheets P1 and insertion sheets P2 that have passed through the relay conveyance passage 11 in the sheet feeding apparatus 2 are fed in via the sheet inlet port 21, which is provided in an upper right part of the sheet post-processing apparatus 3, and pass through the punch hole forming device 22. When these output sheets P1 and insertion sheets P2 do to need stapling, they are discharged as they are onto the subsidiary tray 24*b*; when those sheets need stapling, they are conveyed to the end binding unit 23 or to the middle-binding middle-folding unit 25, either being disposed under the punch hole forming device 22.

The end binding unit 23 includes a stapler, a processing tray, etc. (none of which is illustrated). Output sheets P1 and insertion sheets P2 are stacked on the processing tray to be formed into a bundle of sheets. The bundle of sheets is, with the leading end of the bundle aligned, bound in an end part of it by the stapler, and is then discharged along the processing tray onto the main tray 24*a*.

Disposed under the end binding unit 23, the middle-binding middle-folding unit 25 for middle binding and middle folding includes a middle-binding stapler, a middle-folding device, and sheet guides (none of which is illustrated). The middle-binding stapler staples a middle part of a bundle of sheets stacked inside the sheet guides. The bundle of sheets stapled by the middle-binding stapler is folded about the stapled part by the middle-folding device into the form of a booklet, and is then discharged onto a booklet tray 26.

In the sheet feeding apparatus 2, one sheet feeding apparatus 2 may be provided, or a plurality of sheet stacking portions 10 may be provided as shown in FIG. 1. In a case where a plurality of stacking portions 10 are provided, different kinds of insertion sheets can be stacked on different stacking portions 10 to produce booklets that has different insertion sheets as front covers or back covers.

Next the sheet feeding apparatus 2 according to the present disclosure will be described in detail with reference to FIGS. 2 to 7.

Figure 2:
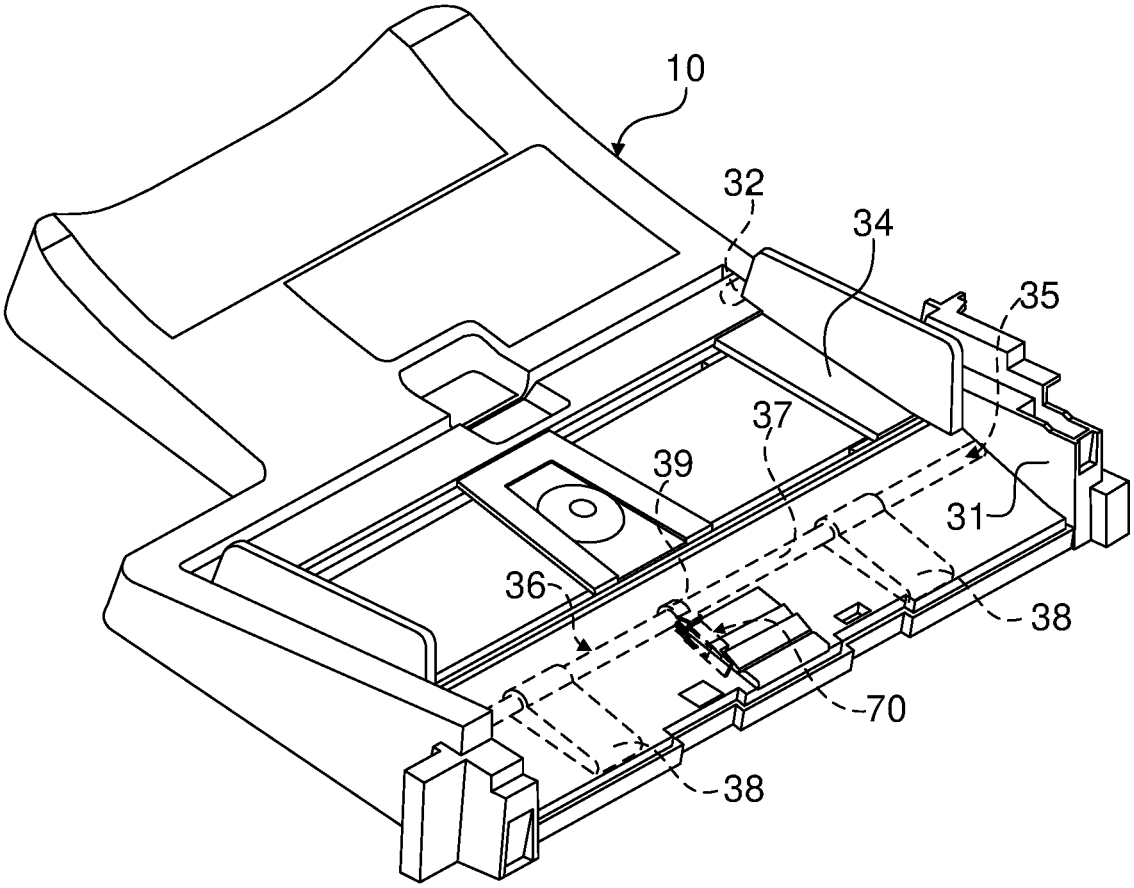
FIG. 2 is a perspective view showing a sheet stacking portion of the sheet feeding apparatus.
Figure 3:
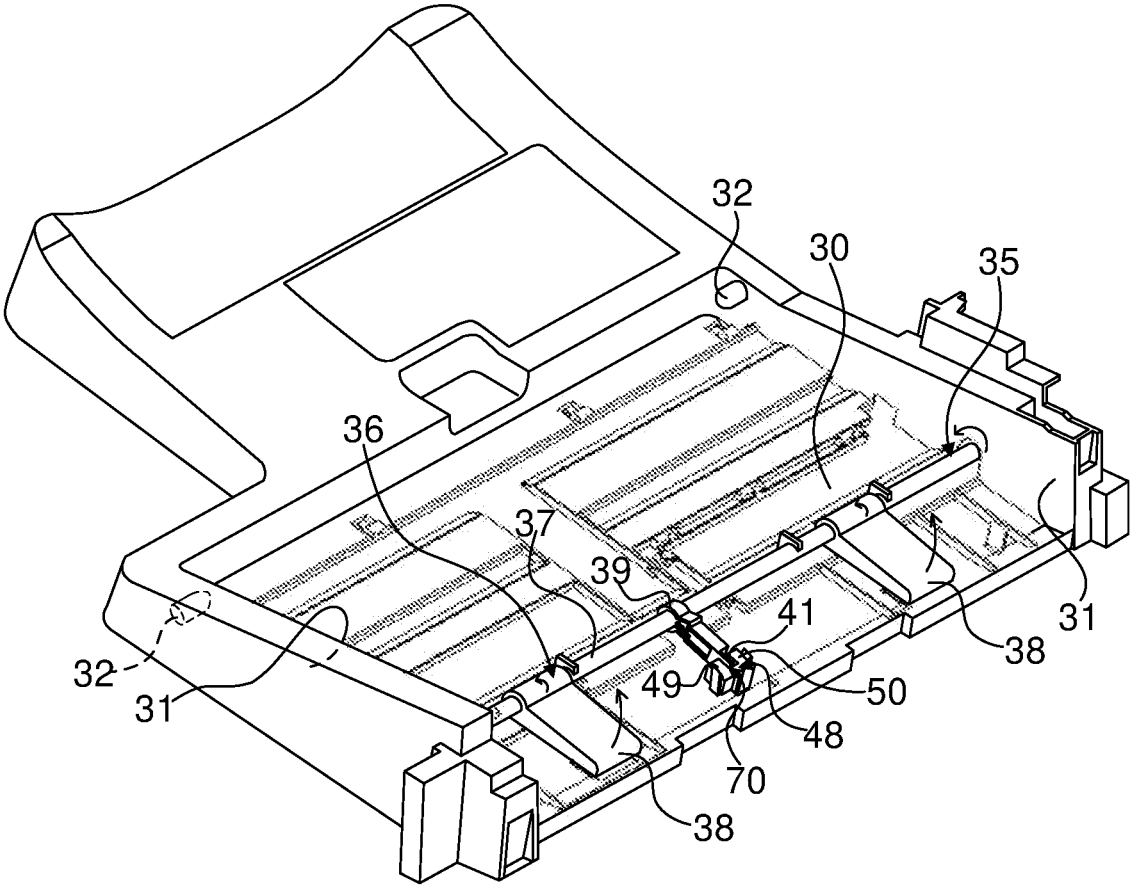
FIG. 3 is a perspective view of the sheet stacking portion in FIG. 2, with a lift plate omitted.
Figure 4:
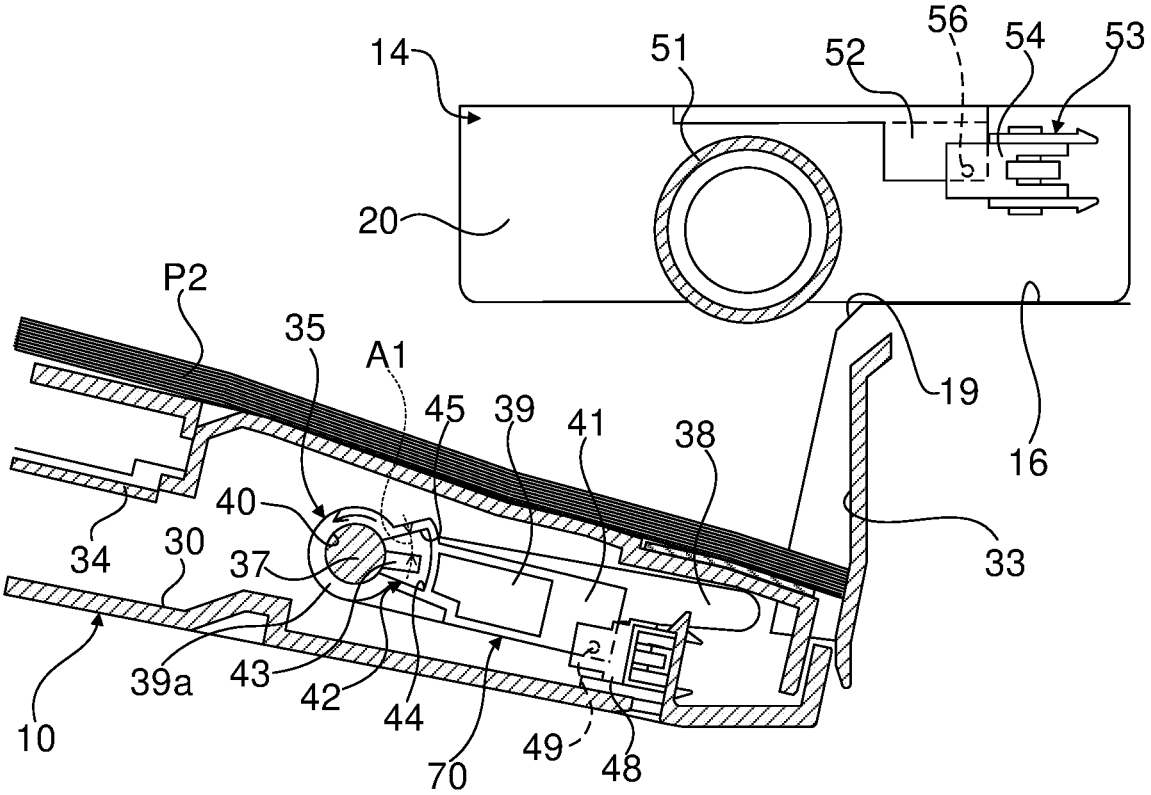
FIG. 4 is a sectional view around a sheet feeding portion as seen from the sheet width direction.

FIG. 2 is a perspective view of one sheet stacking portion 10. FIG. 3 is a perspective view of the sheet stacking portion 10 with the lift plate 34 in FIG. 2 omitted. FIG. 4 is a sectional view around the sheet feeding portion 14 as seen from the sheet width direction. As shown in FIGS. 2 to 4, the sheet stacking portion 10 has an upright wall portion 33, which is located downstream in the sheet conveyance direction; a bottom surface 30, which extends from the upright wall portion 33 and is inclined so as to rise upstream in the sheet conveyance direction; and a pair of side surfaces 31, which face each other across the bottom surface 30 in the sheet width direction (the direction orthogonal to the sheet conveyance direction. The side surfaces 31 have shaft projections 32 formed on them so as to face each other in the sheet width direction. Over the upright wall portion 33, the upstream end opening 19 of the insertion conveyance passage 16 is provided.

On the bottom surface 30 of the sheet stacking portion 10, surrounded by the upright wall portion 33 and the pair of side surfaces 31, a lift plate 34 is disposed. The insertion sheets P2 in the sheet stacking portion 10 are stacked on the lift plate 34. The lift plate 34 is adjacent to the upright wall portion 33 of the sheet stacking portion 10 in the sheet conveyance direction. An upstream end part of the lift plate 34 in the sheet conveyance direction is pivotably supported on the shaft projections 32. Thus the lift plate 34 pivots about the shaft projections 32. As the lift plate 34 pivots about the shaft projections 32, a downstream end part of the lift plate 34 in the sheet conveyance direction ascends and descends in the height direction (the up-down direction in FIG. 4).

Between the bottom surface 30 of the sheet stacking portion 10 and the lift plate 34, a lift mechanism 35 is provided, which raises and lowers the downstream end part of the lift plate 34. The lift mechanism 35 includes a driving unit 36 and a plurality of (here two) actuating segments 38. The driving unit 36 includes a driving source (not illustrated) such as a motor, which generates a driving force, and a driving shaft 37, which is rotatably connected to the driving source. The driving shaft 37 is located under the lift plate 34 and extends in the sheet width direction so as to bridge between the pair of side surfaces 31. The driving shaft 37 is located downstream of the shaft projections 32 in the sheet conveyance direction. The actuating segments 38 are rectangular plate-form members elongate in the sheet conveyance direction. Upstream end parts of the actuating segments 38 are fixed to the driving shaft 37. The actuating segments 38 are disposed at an interval from each other in the sheet width direction. As the driving shaft 37 rotates, the actuating segments 38 rotate about the driving shaft 37. Thu, downstream end parts of the actuating segments 38 swing in the ascent-descent direction (in the up-down direction in FIG. 4).

Figure 5:
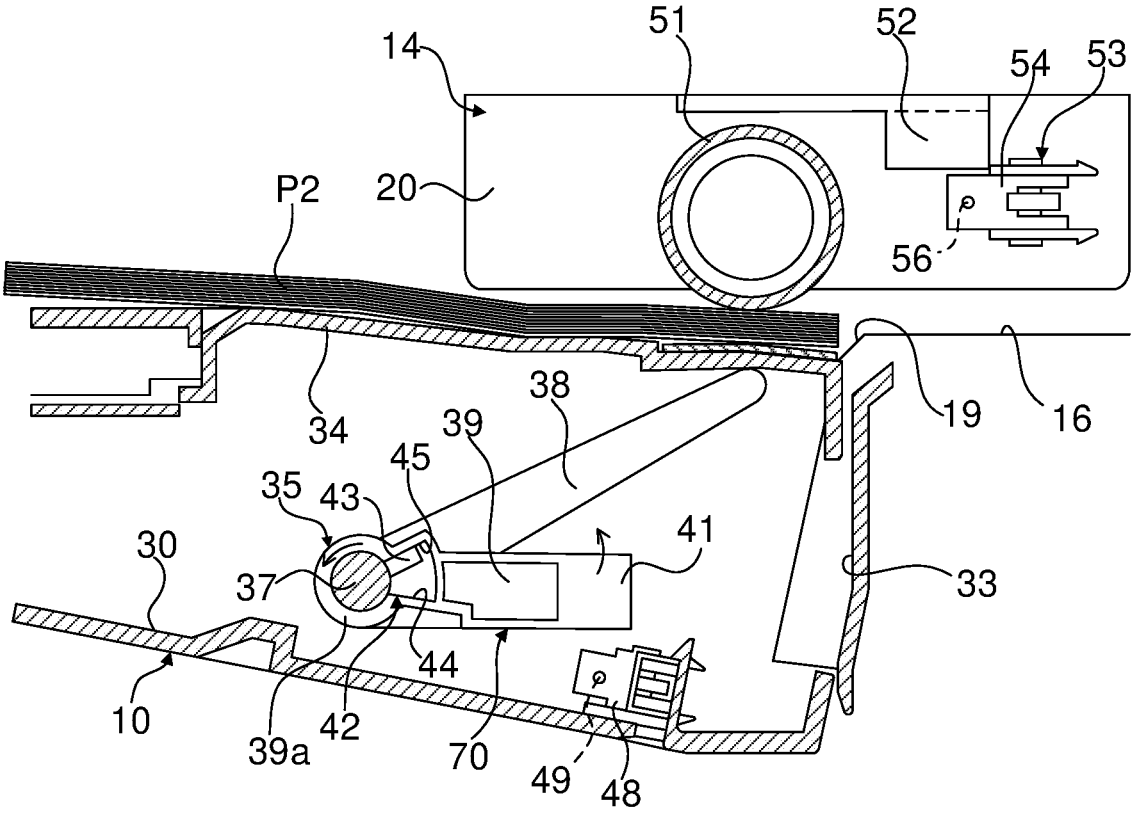
FIG. 5 is a sectional view around the sheet feeding portion as seen from the sheet width direction, in a state where the lift plate has ascended to a position higher than a predetermined height and a detection sensor has sensed the ascent of a light-shielding portion.

Since as mentioned above the driving shaft 37 is disposed under the lift plate 34, also the actuating segments 38, which are fixed to the driving shaft 37, are located under the lift plate 34. Here, as shown in FIG. 5, when the driving shaft 37 rotates counter-clockwise (in the direction indicated by an arrow in the illustration) under the driving force from the driving source, as it rotates, the downstream end parts of the actuating segments 38 ascend. The downstream end parts of the actuating segments 38 then make contact with the bottom surface of the lift plate 34, and the upstream end part of the lift plate 34 is raised. In this way the lift mechanism 35 can raise and lower the downstream end part of the lift plate 34 as the actuating segments 38 swing under the driving force from the driving source.

Referring back to FIGS. 3 and 4, in the sheet stacking portion 10, a remaining amount detection portion 70 is provided, which based on the height of the lift plate 34 senses the remaining quantity of insertion sheets P2 stacked on the sheet stacking portion 10. The remaining amount detection portion 70 includes a detection piece 39, a link mechanism 42, and a detection sensor 48 (second detecting portion).

The detection piece 39 is provided on the driving shaft 37 so as to be adjacent to the actuating segments 38 in the sheet width direction. The detection piece 39 is a small segment elongate in the sheet conveyance direction. In a base end part 39*a* (an upstream end part in the sheet conveyance direction) of the detection piece 39, a through hole 40 (bearing portion) is formed, which penetrates the detection piece 39 in the sheet width direction. Through the through hole 40, the driving shaft 37 is inserted, so that the detection piece 39 is supported on the driving shaft 37 so as to be pivotable about the driving shaft 37. As the detection piece 39 pivots about the driving shaft 37, a downstream end part of the detection piece 39 swings in the ascent-descent direction. The downstream end part of the detection piece 39 descends, under its own weight, until it makes contact with the bottom surface 30 of the sheet stacking portion 10. In the downstream end part of the detection piece 39, a light-shielding portion 41 is formed, which is in the shape of a rectangular plate and which extends downstream in the sheet conveyance direction.

The detection piece 39 and the driving shaft 37 are coupled together via the link mechanism 42. The link mechanism 42 has an engagement segment 43, which projects from the driving shaft 37 in its radial direction, and an engagement hole 44, which is formed in the base end part 39*a* of the detection piece 39 and in which the engagement segment 43 is fitted. The engagement hole 44 is a recess-like hole depressed in the direction in which the engagement segment 43 projects. Of the inner circumferential surface of the engagement hole 44, a top part is formed as an engagement surface 45, which faces the outer circumferential surface of the engagement segment 43 in the circumferential direction of the driving shaft 37.

As shown in FIG. 4, when the actuating segments 38 are located at a relatively low position and the lift plate 34 is lowered (i.e., when the rotation angle of the driving shaft 37 is relatively small), there is a gap A1 (play) between the engagement segment 43 and the engagement surface 45. From this state, as the driving shaft 37 rotates counter-clockwise in the illustration, the engagement segment 43 too rotates about the driving shaft 37, and the gap A1 between the outer circumferential surface of the driving shaft 37 and the engagement surface 45 narrows. From this state, as the driving shaft 37 rotates further, the engagement segment 43 and the engagement surface 45 make contact with each other. Then, as shown in FIG. 5, the rotation of the driving shaft 37 is transmitted via the engagement surface 45 to the detection piece 39, and the detection piece 39 pivots about the driving shaft 37. In this way the detection piece 39 pivots, with timing delayed from the pivoting of the actuating segments 38, so as to follow the actuating segments 38.

Here the detection piece 39, as the driving shaft 37 rotates clockwise in the illustration, descends under its own weight so as to follow the swinging of the actuating segments 38. Even after the detection piece 39 has descended until it makes contact with the bottom surface 30, as the driving shaft 37 rotates as illustrated, a gap A1 reappears between the outer circumferential surface of the engagement segment 43 and the engagement surface 45.

As shown in FIGS. 3 and 4, on the bottom surface 30 of the sheet stacking portion 10, the detection sensor 48 is provided so as to be adjacent to the detection piece 39 in the sheet conveyance direction. The detection sensor 48 has a light-emitting portion 49 and a light-receiving portion 50, which face each other in the sheet width direction. The light-receiving portion 50 receives the light emitted from the light-emitting portion 49.

As shown in FIG. 4, when there is the gap A1 between the engagement segment 43 and the engagement surface 45, the light-shielding portion 41 of the detection piece 39 is located between the light-emitting portion 49 and the light-receiving portion 50 of the detection sensor 48. That is, when the rotation angle of the driving shaft 37 is relatively small and the rotation of the driving shaft 37 is not transmitted to the detection piece 39 the light-shielding portion 41 of the detection piece 39 is at the same height as the light-emitting portion 49 of the detection sensor 48. Thus the light emitted from the light-emitting portion 49 is intercepted by the light-shielding portion 41, and the light-receiving portion 50 cannot receive the light emitted from the light-emitting portion 49.

From this state, when as described above the driving shaft 37 rotates until the light-shielding portion 41 ascends to a position higher than the light-emitting portion 49 (see FIG. 5), the light emitted from the light-emitting portion 49 is received by the light-receiving portion 50. In this way the detection sensor 48 senses the detection piece 39 having ascended to a position higher than the light-emitting portion 49, and this makes it possible to sense the ascent of the downstream end parts of the actuating segments 38, that is, to sense the lift plate 34 having ascended to above a predetermined height. In this way the remaining amount detection portion 70 senses the remaining quantity level, that is, whether or not the remaining quantity of insertion sheets P2 stacked on the lift plate 34 is more or less a predetermined quantity.

As shown in FIG. 4, the sheet feeding portion 14 includes a device body 20, which is disposed over the lift plate 34; a sheet feed roller 51, which is provided on the device body 20; and a light-shielding segment 52, which protrudes from the device body 20 in the sheet width direction. The device body 20 is provided so as to be ascendable-descendable in the up-down direction in the illustration. The sheet feed roller 51 is adjacent to the upstream end opening 19 of the insertion conveyance passage 16 in the sheet conveyance direction.

At a position facing the device body 20 in the sheet width direction, an ascent-descent sensor 54 is provided. The ascent-descent sensor 54 has a light-emitting portion 56 and a light-receiving portion (not illustrated), which face each other in the sheet width direction. The light-receiving portion of the ascent-descent sensor 54 receives the light emitted from the light-emitting portion 56. The ascent-descent sensor 54 and the light-shielding segment 52 constitute a top surface detecting mechanism 53 (first detecting portion). The top surface detecting mechanism 53 can sense the insertion sheets P2 being in contact with the sheet feed roller 51 and the device body 20 being at a position higher than a predetermined height.

As shown in FIG. 4, with the sheet feed roller 51 out of contact with the top surface of the insertion sheets P2, the light-shielding segment 52 is located between the light-emitting portion 56 and the light-receiving portion of the ascent-descent sensor 54. Thus the light-shielding segment 52 intercepts the light emitted from the light-emitting portion 56 of the ascent-descent sensor 54.

Figure 6A:
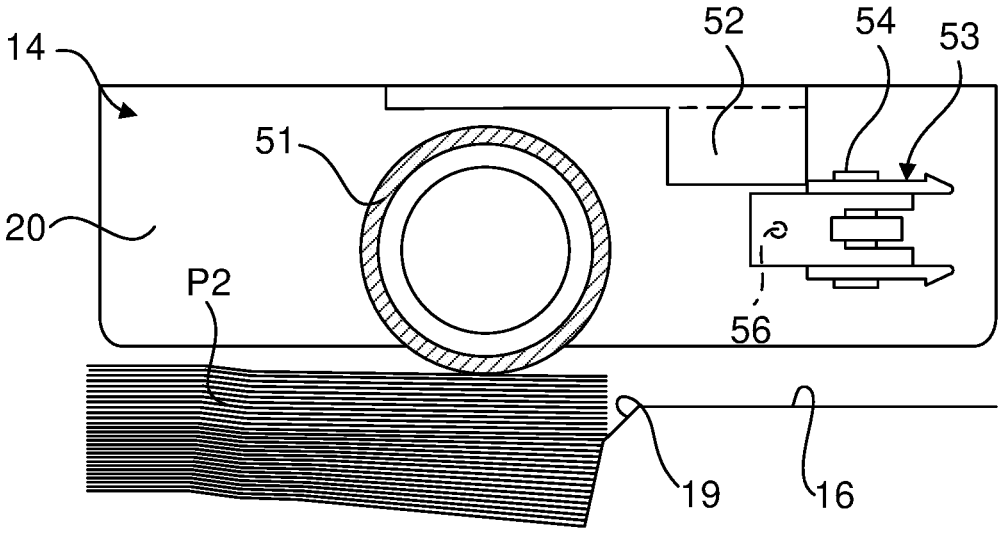
FIG. 6A is an enlarged part view around the sheet feeding portion, in a state where a light-receiving portion of an ascent-descent sensor is receiving light emitted from its light-emitting portion.
Figure 6B:
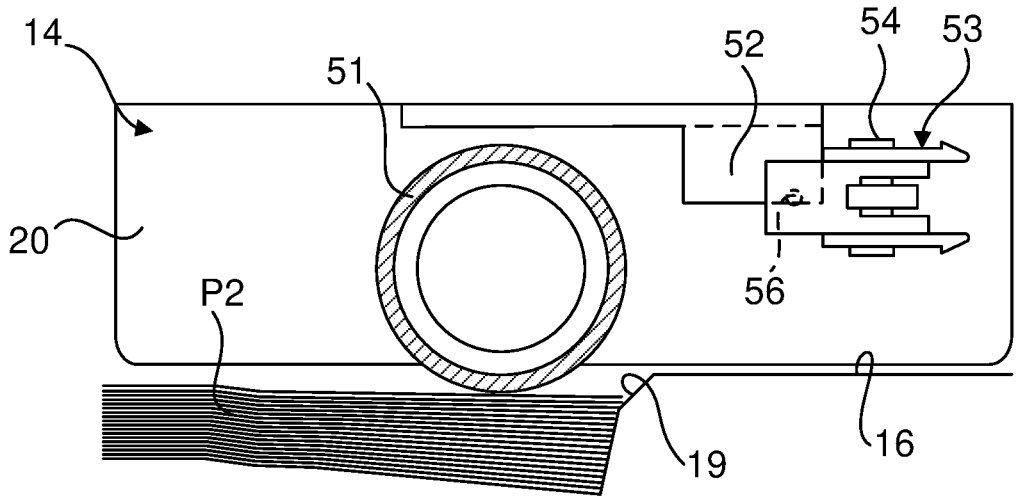
FIG. 6B is an enlarged part view around the sheet feeding portion, in a state where a light-shielding segment is intercepting the light emitted from the light-emitting portion of the ascent-descent sensor.

FIG. 6A is an enlarged part view around the sheet feeding portion 14, in a state where the light-receiving portion of the ascent-descent sensor 54 is receiving the light emitted from the light-emitting portion 56. FIG. 6B is an enlarged part view around the sheet feeding portion 14, in a state where the light-shielding segment 52 is intercepting the light emitted from the light-emitting portion 56 of the ascent-descent sensor 54.

As shown in FIG. 6A, when the top surface of the insertion sheet P2 is in contact with the sheet feed roller 51, as the sheet feed roller 51 rotates in the sheet conveyance direction (counter-clockwise in the illustration), one insertion sheet P2 in contact with the sheet feed roller 51 is fed toward the upstream end opening 19 of the relay conveyance passage 11. With that one insertion sheet P2 fed out, the insertion sheet P2 stacked just under it now makes contact with the sheet feed roller 51. In this way, while the sheet feed roller 51 keeps rotating, the insertion sheets P2 on the sheet stacking portion 10 are fed out one by one from the top. Thus the sheet feed roller 51 can continuously feed, out of a plurality of insertion sheets P2, the insertion sheet P2 located at the top surface one by one to the insertion conveyance passage 16.

While from the state shown in FIG. 6A the insertion sheets P2 on the sheet stacking portion 10 are fed one by one to the insertion conveyance passage 16, as the remaining quantity of insertion sheets P2 lessens, the position of the top surface of the insertion sheets P2 on the sheet stacking portion 10 lowers. Thus the force pressing the sheet feed roller 51 weakens, and the sheet feeding apparatus device body 20 descends. As the device body 20 descends, as shown in FIG. 6B, the light-shielding segment 52 moves back to between the light-emitting portion 56 and the light-receiving portion of the ascent-descent sensor 54. Thus the light emitted from the light-emitting portion 56 is intercepted by the light-shielding segment 52.

Here the sheet feeding apparatus 2 includes a controller 90 (see FIG. 1). The controller 90 is connected to the driving source, the detection sensor 48, and the ascent-descent sensor 54. Based on the detecting result of the ascent-descent sensor 54, the controller 90 can control the operation of the driving source.

Specifically, when as described above the device body 20 descends until the light-shielding segment 52 intercepts the light emitted from the light-emitting portion 56 of the ascent-descent sensor 54, the controller 90 raises the lift plate 34. Thus the top surface of the insertion sheets P2 ascends and the device body 20 ascends back. When the light-shielding segment 52 rises until it moves away from between the light-emitting portion 56 and the light-receiving portion of the ascent-descent sensor 54, the light-receiving portion of the ascent-descent sensor 54 receives the light emitted from the light-emitting portion 56. Then the controller 90 stops raising the lift plate 34. The controller 90 raises and lowers the lift plate 34 by controlling the driving source.

Figure 7:
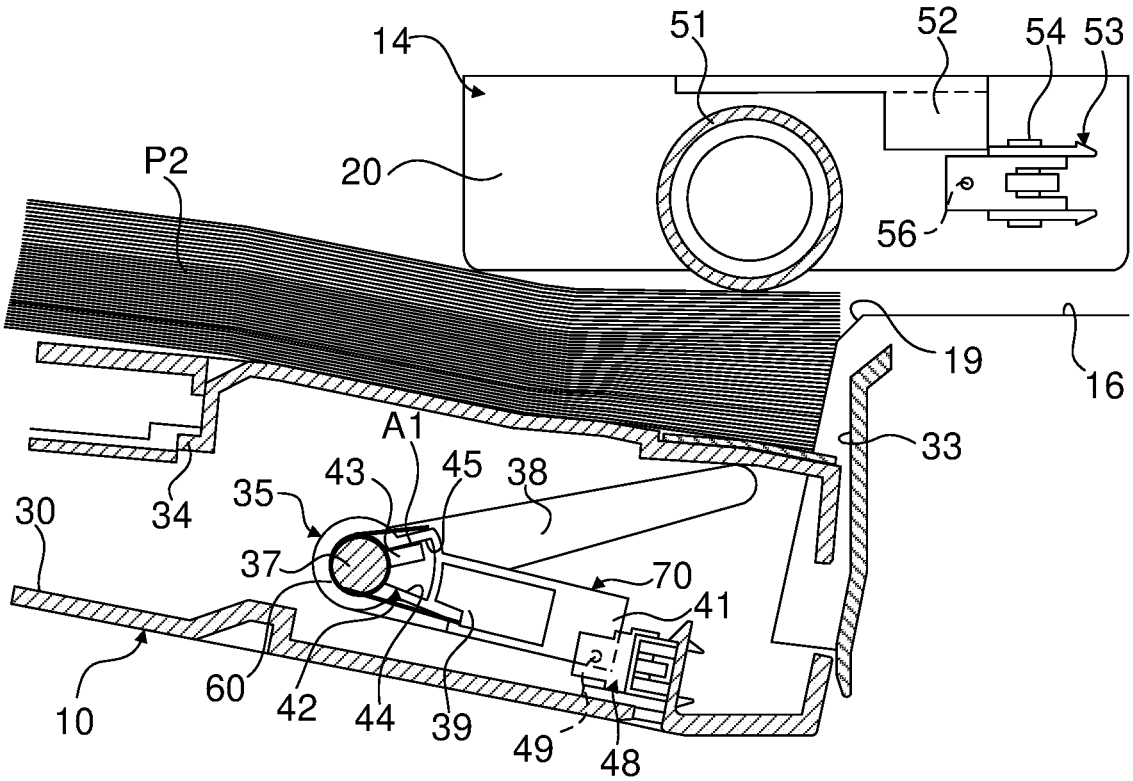
FIG. 7 is a side sectional view of the sheet stacking portion as seen from the sheet width direction, in a state where the remaining quantity of insertion sheets is more than a predetermined quantity.

FIG. 7 is a sectional view of the sheet stacking portion 10 as seen from the sheet width direction, in a state where the remaining quantity of insertion sheets P2 is more than a predetermined quantity. As described above, the controller 90 raises the lift plate 34 until the top surface of the insertion sheets P2 makes contact with the sheet feed roller 51 and the ascent-descent sensor 54 senses the ascent of the light-shielding segment 52. When the remaining quantity of insertion sheets P2 is more than a predetermined quantity, the lift plate 34 can only ascend up to a position lower than a predetermined height. In this state there is a small gap A1 between the outer circumferential surface of the engagement segment 43 and the engagement surface 45, and the rotation of the driving shaft 37 is not transmitted to the detection piece 39. Thus the downstream end part (light-shielding portion 41) of the detection piece 39 is not raised, and is located between the light-emitting portion 49 and the light-receiving portion 50 of the detection sensor 48. Thus the detection sensor 48 senses the detection piece 39 not being raised.

From this state, as the sheet feed roller 51 rotates in the sheet conveyance direction and feeds out the insertion sheets P2 one by one, as described above, the top surface of the insertion sheets P2 lowers. In response the controller 90 controls the driving source to rotate the driving shaft 37. Thus the engagement segment 43 pivots counter-clockwise about the driving shaft 37, and the gap A1 between the outer circumferential surface of the engagement segment 43 and the engagement surface 45 narrows. When the driving shaft 37 rotates further until the gap A1 disappears and the outer circumferential surface of the engagement segment 43 makes contact with the engagement surface 45, the rotation of the driving shaft 37 is transmitted to the detection piece 39. From this state, as the driving shaft 37 rotates further, the detection piece 39 gradually pivots counter-clockwise about the driving shaft 37. When the remaining quantity of insertion sheets P2 becomes less than a predetermined quantity, the light-shielding portion 41 of the detection piece 39 reaches a position higher than the light-emitting portion 49 of the detection sensor 48. Now the light-receiving portion 50 of the detection sensor 48 receives the light emitted from the light-emitting portion 49. In this way the detection sensor 48 senses the ascent of the downstream end part (light-shielding portion 41) of the detection piece 39.

The sheet feeding apparatus 2 includes a transmission device (not illustrated) that transmits the detecting result of the detection sensor 48 to the image forming apparatus 1 and the sheet post-processing apparatus 3. Usable as the transmission device is, for example, an information communication device of a wired or wireless type. When the detection sensor 48 senses the ascent of the light-shielding portion 41 of the detection piece 39 (i.e., when it senses the remaining quantity of insertion sheets P2 becoming lower than the predetermined quantity), the transmission device transmits the detecting result to the image forming apparatus 1. In response the image forming apparatus 1 controls the sheet feeding portion 5 to adjust the timing with which output sheets P1 are fed from the sheet feeding cassette 4*a*, so as not to produce a booklet without a front cover.

The embodiment described above is in no way meant to limit the scope of the present disclosure, which can thus be implemented with many modifications made without departure from the spirit of the present disclosure. For example, a construction is also possible where the lift mechanism 35 has a recess-like engagement hole 44 formed so as to be depressed in a radial direction from the outer circumferential surface of the driving shaft and a boss-like engagement segment 43 extending from the detection piece 39 toward the driving shaft and fitted in the engagement hole 44.

A construction is also possible where as shown in FIG. 7 the sheet stacking portion 10 includes a torsion spring 60 that urges the detection piece 39 toward the bottom surface 30 of the sheet stacking portion 10. With this construction, when the driving shaft rotates until the outer circumferential surface of the engagement segment 43 makes contact with the engagement surface 45, the lift mechanism 35 makes the detection piece 39 pivot against the urging force of the torsion spring 60. With this construction, the detection piece 39 can reliably be lowered so as to follow the descent of the actuating segment 38, and it is thus possible to prevent erroneous detecting of the remaining quantity of insertion sheets P2.

The present disclosure finds applications in sheet feeding apparatuses for inserting, with predetermined timing, insertion sheets among a plurality of output sheets output from a image forming apparatus. Based on the present disclosure, it is possible to provide, for image forming systems comprising an image forming apparatus, a sheet feeding apparatus, and a sheet post-processing apparatus, a sheet feeding apparatus that can sense a low remaining quantity of insertion sheets and thereby prevent production of a booklet without a front cover or the like with a simple construction without requiring complicate software.

What is claimed is:

1. A sheet feeding apparatus, comprising:

a sheet stacking portion on which sheets are stacked;

a lift plate which is disposed on a bottom surface of the sheet stacking portion, the lift plate being ascendable-descendable about an upstream end part of the lift plate in a sheet feed direction;

an actuating segment which is disposed between the bottom surface and the lift plate, the actuating segment pivoting about a driving shaft extending in a direction orthogonal to the sheet feed direction so as to raise and lower a downstream end part of the lift plate in the sheet feed direction;

a driving unit which is coupled to the driving shaft, the driving unit configured to rotate the driving shaft to raise and lower the actuating segment;

a sheet feeding portion which is disposed above and opposite to the lift plate, the sheet feeding portion feeding sheets raised to a feeding portion by the lift plate;

a first detecting portion which detects a top surface of the sheets located at the feeding portion; and a remaining amount detection portion which detects a remaining amount level of sheets stacked on the feeding portion, the remaining amount detecting portion including:

a detection piece of which a base end part is pivoted on the driving shaft, the detection piece being pivotable about the driving shaft;

a link mechanism which couples together the driving shaft and the detection piece at a coupling position where the lift plate is rotated by a predetermined angle from a lower limit position in a rotation direction, and integrally rotates the driving shaft and the detection piece;

a second detecting portion configured to detect whether or not, with the lift plate located at the feeding portion, the detection piece is present; and a controller which determines the remaining amount level of the stacked sheets according to whether or not, with the first detecting portion detecting the top surface of the sheets, the second detecting portion is detecting the detection piece being present, wherein the link mechanism is configured to have a play allowing the detection piece to rotate by the predetermined angle with respect to the driving shaft, with the lift plate located at the lower limit position, and when as a result of the driving shaft rotating forward the lift plate rotates by the predetermined angle to ascend, the link mechanism is coupled to eliminate the play so that the detection piece starts to rotate as the lift plate rotates, and when the detection piece ascends by a predetermined amount, the second detecting portion detects ascent of the detection piece to detect that the remaining amount of sheets is equal to or less than the predetermined amount.

2. An image forming system, comprising:

an image forming apparatus which forms images on sheets;

a sheet post-processing apparatus which performs predetermined post-processing on a bundle of sheets output from the image forming apparatus; and the sheet feeding apparatus according to claim 1 which is attached to the sheet post-processing apparatus to serve as an inserter that inserts sheets into the bundle of sheets.

3. A sheet feeding apparatus, comprising:

a sheet stacking portion on which sheets are stacked;

a lift plate which is disposed on a bottom surface of the sheet stacking portion, the lift plate being ascendable-descendable about an upstream end part of the lift plate in a sheet feed direction;

an actuating segment which is disposed between the bottom surface and the lift plate, the actuating segment pivoting about a driving shaft extending in a direction orthogonal to the sheet feed direction so as to raise and lower a downstream end part of the lift plate in the sheet feed direction;

a driving unit which is coupled to the driving shaft, the driving unit configured to rotate the driving shaft to raise and lower the actuating segment;

a sheet feeding portion which is disposed above and opposite to the lift plate, the sheet feeding portion feeding sheets raised to a feeding portion by the lift plate;

a first detecting portion which detects a top surface of the sheets located at the feeding portion; and a remaining amount detection portion which detects a remaining amount level of sheets stacked on the feeding portion, the remaining amount detecting portion including:

a detection piece of which a base end part is pivoted on the driving shaft, the detection piece being pivotable about the driving shaft;

a link mechanism which couples together the driving shaft and the detection piece at a coupling position where the lift plate is rotated by a predetermined angle from a lower limit position in a rotation direction, and integrally rotates the driving shaft and the detection piece;

a second detecting portion configured to detect whether or not, with the lift plate located at the feeding portion, the detection piece is present; and a controller which determines the remaining amount level of the stacked sheets according to whether or not, with the first detecting portion detecting the top surface of the sheets, the second detecting portion is detecting the detection piece being present, wherein one end part of the actuating segment is fixed to the driving shaft, and as a result of the other end part of the actuating segment swinging as the driving shaft rotates, the actuating segment raises and lowers the lift plate, one end part of the detection piece is supported so as to be rotatable with respect to the driving shaft, with the lift plate located at the lower limit position, the link mechanism permits the detection piece to pivot about the driving shaft and, with the lift plate located at the coupling position, which is above the lower limit position, the link mechanism couples together the detection piece and the driving shaft to let them rotate together, and the detection piece is detected by the second detecting portion at least at a position between the lower limit position and the coupling position.

4. A sheet feeding apparatus, comprising:

a sheet stacking portion on which sheets are stacked;

a lift plate which is disposed on a bottom surface of the sheet stacking portion, the lift plate being ascendable-descendable about an upstream end part of the lift plate in a sheet feed direction;

an actuating segment which is disposed between the bottom surface and the lift plate, the actuating segment pivoting about a driving shaft extending in a direction orthogonal to the sheet feed direction so as to raise and lower a downstream end part of the lift plate in the sheet feed direction;

a driving unit which is coupled to the driving shaft, the driving unit configured to rotate the driving shaft to raise and lower the actuating segment;

a sheet feeding portion which is disposed above and opposite to the lift plate, the sheet feeding portion feeding sheets raised to a feeding portion b the lift plate;

a first detecting portion which detects a top surface of the sheets located at the feeding portion; and a remaining amount detection portion which detects a remaining amount level of sheets stacked on the feeding portion, the remaining amount detecting portion including:

a detection piece of which a base end part is pivoted on the driving shaft, the detection piece being pivotable about the driving shaft, a link mechanism which couples together the driving shaft and the detection piece at a coupling position where the lift plate is rotated by a predetermined aide from a lower limit position in a rotation direction, and integrally rotates the driving shaft and the detection piece;

a second detecting portion configured to detect whether or not, with the lift plate located at the feeding portion, the detection piece is present; and a controller which determines the remaining amount level of the stacked sheets according to whether or not, with the first detecting portion detecting the top surface of the sheets, the second detecting portion is detecting the detection piece being present, wherein the link mechanism includes:

an engagement segment which projects from the driving shaft in a radial direction thereof;

a bearing portion which is formed in the base end part of the detection piece and through which the driving shaft is inserted, and an engagement hole which extends outward from the bearing portion in a radial direction thereof and in which the engagement segment is fitted, when the driving shaft rotates and the actuating segment pivots upward, the engagement segment moves in a forward rotation direction in the engagement hole to engage with an inner wall surface of the engagement hole on a downstream side in the forward rotation direction, so that the detection piece rotates integrally with the rotation shaft.

5. A sheet feeding apparatus, comprising:

a sheet stacking portion on which sheets are stacked;

a lift plate which is disposed on a bottom surface of the sheet stacking portion, the lift plate being ascendable-descendable about an upstream end part of the lift plate in a sheet feed direction;

an actuating segment which is disposed between the bottom surface and the lift plate, the actuating segment pivoting about a driving shaft extending in a direction orthogonal to the sheet feed direction so as to raise and lower a downstream end part of the lift plate in the sheet feed direction;

a driving unit which is coupled to the driving shaft, the driving unit configured to rotate the driving shaft to raise and lower the actuating segment;

a sheet feeding portion which is disposed above and opposite to the lift plate, the sheet feeding portion feeding sheets raised to a feeding portion by the lift plate;

a first detecting portion which detects a top surface of the sheets located at the feeding portion;

a remaining amount detection portion which detects a remaining amount level of sheets stacked on the feeding portion, the remaining amount detecting portion including:

a detection piece of which a base end part is pivoted on the driving shaft, the detection piece being pivotable about the driving shaft;

a link mechanism which couples together the driving shaft and the detection piece at a coupling position where the lift plate is rotated by a predetermined angle from a lower limit position in a rotation direction, and integrally rotates the driving shaft and the detection piece;

a second detecting portion configured to detect whether or not, with the lift plate located at the feeding portion, the detection piece is present; and a controller which determines the remaining amount level of the stacked sheets according to whether or not, with the first detecting portion detecting the top surface of the sheets, the second detecting portion is detecting the detection piece being present; and a torsion spring which is fitted around the driving shaft, one end of the torsion spring being fixed to the sheet stacking portion, another end of the torsion spring lying in contact with the detection piece, the torsion spring urging the detection piece toward the bottom surface of the sheet stacking portion.

* * * * *